US010107584B1

(12) United States Patent
Anderson

(10) Patent No.: US 10,107,584 B1
(45) Date of Patent: Oct. 23, 2018

(54) COCKING SLED AND ARROW RELEASE FOR CROSSBOWS

(71) Applicant: Jeffrey R. Anderson, Wauconda, IL (US)

(72) Inventor: Jeffrey R. Anderson, Wauconda, IL (US)

( * ) Notice: Subject to any disclaimer, the term of this patent is extended or adjusted under 35 U.S.C. 154(b) by 0 days.

(21) Appl. No.: 15/909,317

(22) Filed: Mar. 1, 2018

Related U.S. Application Data

(63) Continuation-in-part of application No. 15/585,760, filed on May 3, 2017, now Pat. No. 9,921,026.

(51) Int. Cl.
*F41B 5/12* (2006.01)
*F41B 5/14* (2006.01)

(52) U.S. Cl.
CPC ..... *F41B 5/1469* (2013.01); *F41B 5/12* (2013.01); *F41B 5/143* (2013.01)

(58) Field of Classification Search
CPC ..... F41B 5/12; F41B 5/123
See application file for complete search history.

(56) References Cited

U.S. PATENT DOCUMENTS 4,829,974 A 5/1989 Anderson
4,958,617 A 9/1990 Anderson
5,119,797 A 6/1992 Anderson
5,263,465 A 11/1993 Anderson
5,649,520 A 7/1997 Bednar
6,142,133 A 11/2000 Anderson
6,715,481 B1 4/2004 Anderson
6,752,136 B1 6/2004 Anderson
7,823,572 B2 11/2010 Anderson
8,127,752 B2 3/2012 Bednar et al.
8,157,680 B2 4/2012 Anderson
8,220,445 B2 7/2012 Bednar et al.
8,800,540 B1 8/2014 Choma
9,004,053 B1 4/2015 Anderson
9,022,013 B2 5/2015 Trpkowski
(Continued)

*Primary Examiner* — John Ricci
(74) *Attorney, Agent, or Firm* — Rolland Hackbart

(57) ABSTRACT

An improved moveable cocking sled (5) and arrow release (7) for crossbows is described in the disclosure and illustrated in the embodiments in the drawings, where the cocking sled (5) may be latched to the crossbow string (1) and will couple to and be securely held by the arrow release (7) when the cocking sled (5) is drawn to cock the string (1). The cocking sled (5) includes two string latches (2), two latch release sears (4), two pulleys (3) for engaging corresponding ends of a cocking rope (30), and a rectangular hole (6) with a reverse-angle side tilted toward the crossbow string (1) at approximately a five degree angle. The string latches (2) each have a respective axle on which they rotate "open" and "closed". The string latches (2) rotate "open" in response to a downward motion of their respective latch release sears (4) and rotate "closed" when moved forward by a shooter and pushed against the crossbow string (1). The illustrated crossbows include cheek guard covers (28) that rotate on the respective hinges (41) from the "open" position up to the "closed" position where they cover the cocked crossbow string (1) to prevent injury to the user's face should the crossbow string (1) malfunction or break. When a shooter's face is resting against one of the cheek guard covers (28) to aim or shoot the crossbow, the cocked string (1) latched by the cocking sled (5) is behind the front side of the shooter's face.

18 Claims, 14 Drawing Sheets

(56) References Cited

U.S. PATENT DOCUMENTS

| | | | |
|---|---|---|---|
| 9,494,380 | B1 | 11/2016 | Yehle |
| 9,658,025 | B2 | 5/2017 | Trpkovski |
| 2010/0012108 | A1 | 1/2010 | Bednar et al. |
| 2010/0170488 | A1 | 7/2010 | Rasor et al. |
| 2017/0108307 | A1 | 4/2017 | Yehle |
| 2017/0122695 | A1 | 5/2017 | Yehle |

Fig. 11
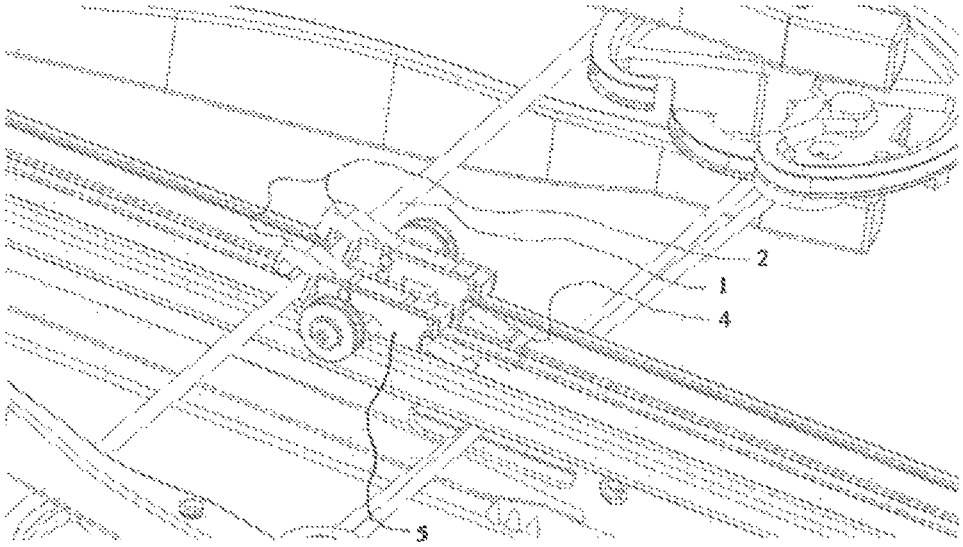
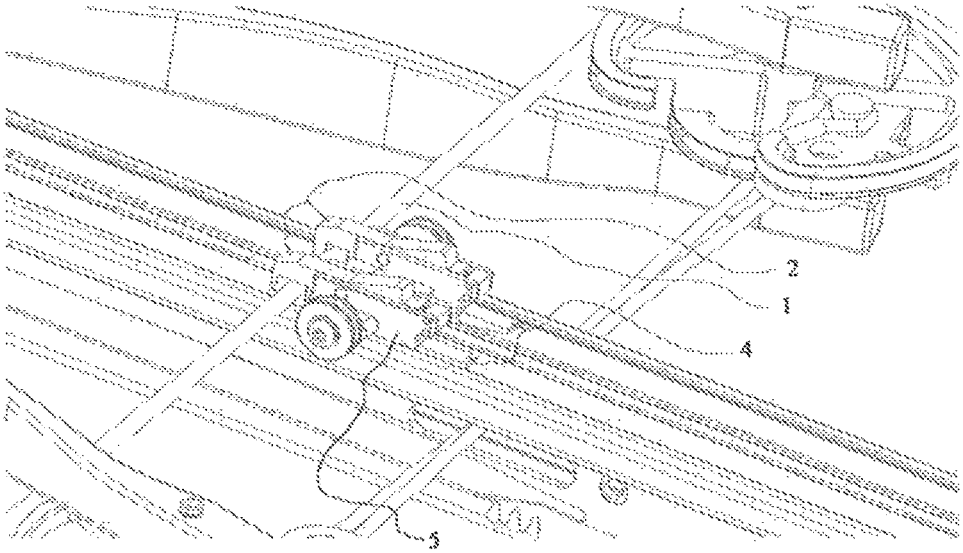
Fig. 12

COCKING SLED AND ARROW RELEASE FOR CROSSBOWS

REFERENCE TO RELATED APPLICATIONS

The instant patent application is a continuation-in-part of co-pending U.S. patent application Ser. No. 15/585,760, filed on May 3, 2017, invented by Jeffrey R. Anderson, and entitled "Elongated Draw Compact Crossbow", which is incorporated herein in its entirety by reference.

TECHNICAL FIELD

The present disclosure relates generally to the field of archery crossbows, and more particularly to an improved moveable cocking sled for latching and coupling a crossbow string to a stationary arrow release when cocking a crossbow.

BACKGROUND

Conventional crossbows such as those disclosed in of U.S. Pat. No. 8,127,752 and U.S. Pat. No. 8,800,540, typically include a string release that is permanently attached to the crossbow in front of the front side of a shooter's face when aiming and shooting a crossbow bolt or arrow to keep the string from contacting the shooter's face. In FIG. 1 of U.S. Patent Application No. 201010170488 and in FIG. 28A of U.S. Patent Application No. 2017/0122695, crossbows are disclosed which include an entire string release that moves forward to engage the crossbow string and is drawn backward and held in front of the shooter's face during cocking. However, such prior art string releases in those depicted crossbows are relatively large and can become dangerous projectiles due to their substantial mass if a cocking rope breaks or a crank cocking device malfunctions during the cocking process. Accordingly, there is a need for an improved moveable cocking sled for latching a crossbow string and that is coupled to and held by a stationary arrow release when cocking a crossbow that is safer and more reliable than prior art moveable string releases.

BRIEF DESCRIPTION OF THE DRAWINGS

FIG. 11 is a partial left-side perspective view of an elongated-draw compact crossbow in FIG. 9; where the string latches of the cocking sled in the "open" position have been moved toward and touch the crossbow string.

FIG. 12 is a left-side perspective view of the elongated-draw compact crossbow in FIG. 11; where the string latches of the cocking sled have been pushed against the crossbow string to close the string latches over the string.

DETAILED DESCRIPTION OF THE DRAWINGS

An improved moveable cocking sled and an arrow release for a crossbow illustrative of the present disclosure comprises a moveable cocking sled, an arrow release, and a cover for the cocked crossbow string near a shooter's face. The crossbow comprises a first limb and a second limb, the first limb and the second limb each having a first end and a second end, a riser coupled to the first end of the first limb and the first end of the second limb, a first cam with an axle coupled to the second end of the first limb, the first cam having an outside perimeter, a second cam with an axle coupled to the second end of the second limb, the second cam having an outside perimeter, a string extending between the first cam and the second cam, a lower barrel having side rails and a channel, the lower barrel having a muzzle end and a butt end, and the muzzle end of the lower barrel coupled to the riser. The movable cocking sled moves along the rails of the lower barrel and is adapted to latch to the string when moved against the string. The moveable cocking sled is retained by the channel of the lower barrel in one embodiment and retained by the channel between the lower barrel and the upper barrel in another embodiment. The arrow release is coupled to and held stationary by the lower barrel near the butt end of the lower barrel. The arrow release is adapted to couple to and hold the movable cocking sled when the cocking sled is latched to the string and moved along the rails of the lower barrel to cock the string. When the string is cocked, the cocked string is behind the front side of a shooter's face when aiming and shooting. A cover is coupled to the lower barrel near the butt end thereof and adapted to rotate toward the lower barrel to cover the string near a shooter's face after the string is cocked.

Figure 1:
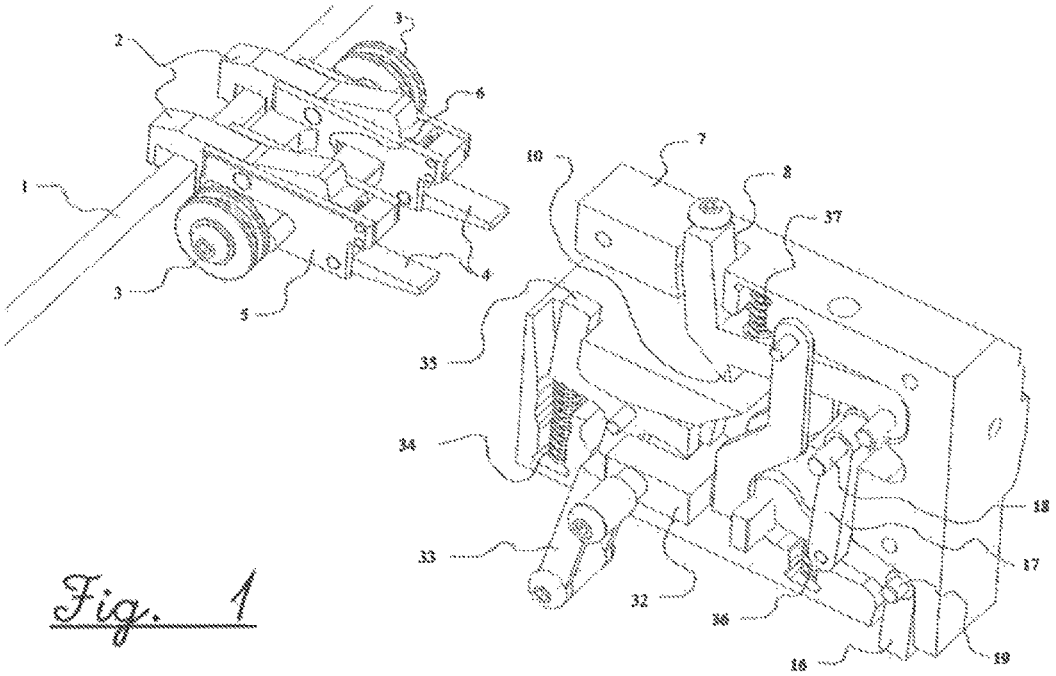
FIG. 1 is a left-side perspective view of an improved cocking sled and arrow release of the elongated-draw compact crossbows in FIGS. 5-10; where the cocking sled is latched to a crossbow string and will couple to the arrow release when the cocking sled is drawn to cock the crossbow.

Referring now to FIG. 1, there is illustrated a left-side perspective view of an improved cocking sled 5 and arrow release 7 of the elongated-draw compact crossbows in FIGS. 5-10; where the cocking sled 5 is latched to the crossbow string 1 and will couple to and be held by the arrow release 7 when the cocking sled 5 is drawn to cock the crossbow, illustrative of an embodiment of the present disclosure.

The cocking sled 5 includes two string latches 2, two latch release sears 4, two pulleys 3 for engaging corresponding ends of a cocking rope 30 (see FIG. 10 and FIG. 12), and a rectangular hole 6 with a reverse-angle side tilted toward the crossbow string 1 at approximately a five degree angle. The two string latches 2 in FIG. 1 are shown "closed" over the string 1. The string latches 2 each have a respective axle on which they rotate "open" (upward direction) and "closed" (downward direction). The string latches 2 rotate "open" in response to a downward motion of their respective latch release sears 4 and rotate "closed" when moved forward by a shooter and pushed against the crossbow string 1. The string latches 2 make an audible snap when they rotate and latch "closed".

Figure 2:
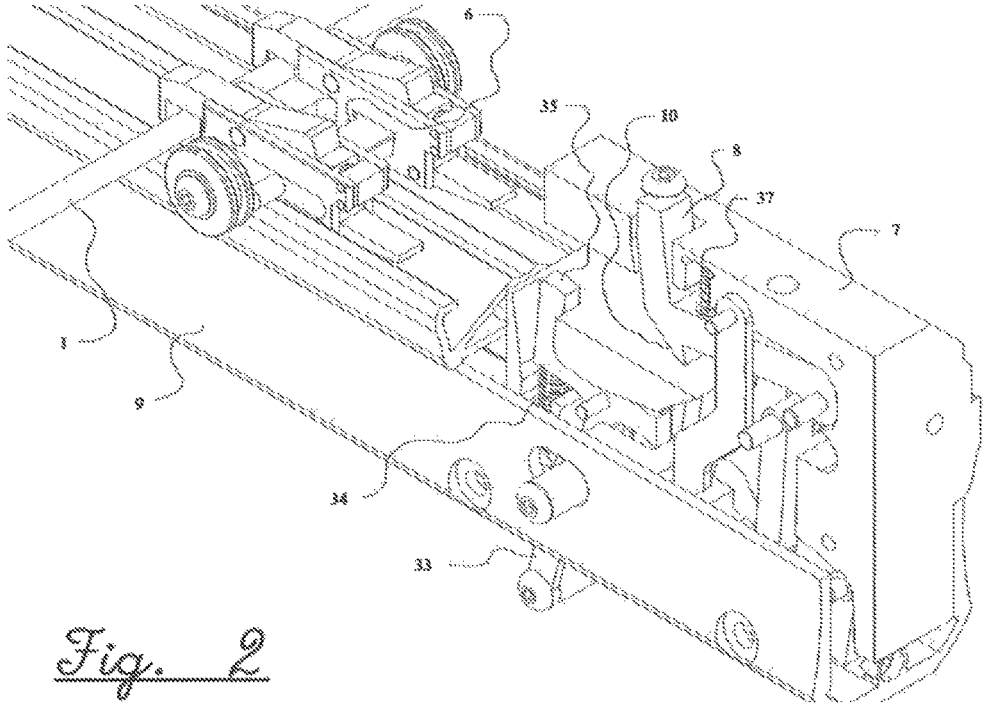
FIG. 2 is a left-side perspective view of the improved cocking sled and arrow release in FIG. 1; where the cocking sled is disposed between side rails of the lower barrel of the elongated-draw compact crossbows in FIGS. 5-10, where the arrow release is attached to the sides of the lower barrel near the butt end of the crossbow, and where the cocking sled is positioned next to the arrow release.
Figure 16:
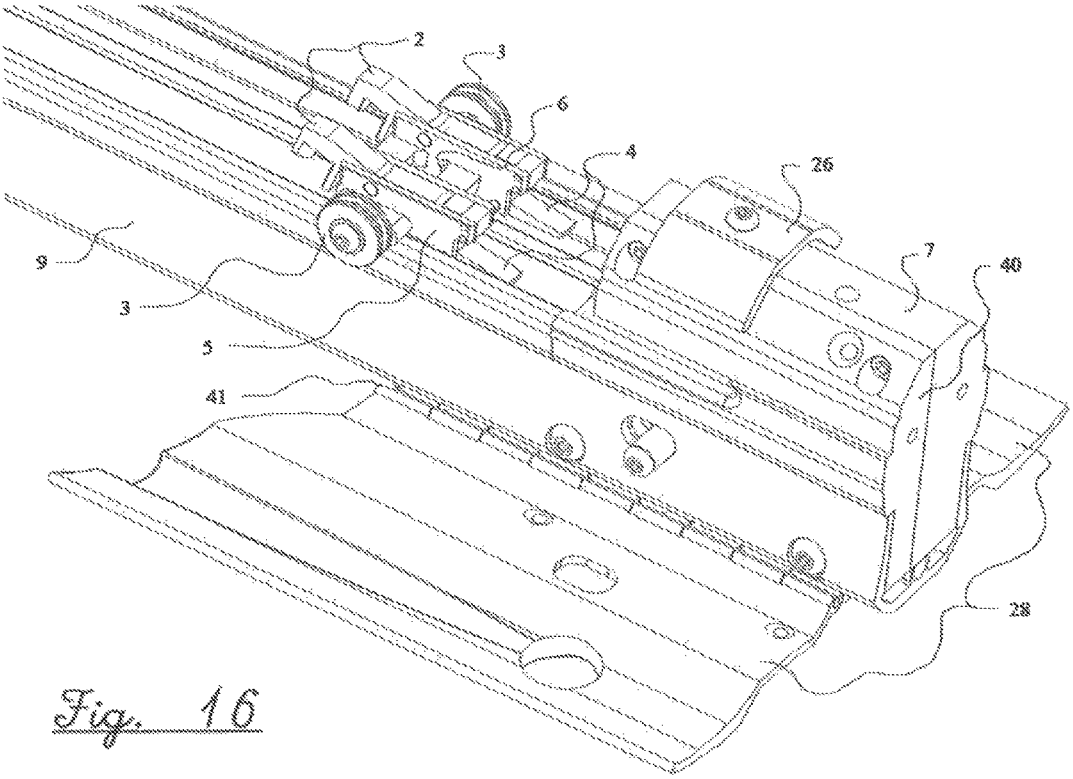
FIG. 16 is a left-side perspective view of the arrow release in FIG. 2 together with the left-side housing cover of the arrow release not shown in FIG. 2.

The arrow release 7 includes a right side housing portion and internal components illustrated in FIG. 1 and FIG. 2 and a left side housing portion 40 illustrated in FIG. 16, which left side housing portion 40 and right side housing portion of the arrow release 7 are attached to and held together between respective sides of the lower barrel 9 and by screws. The arrow release 7 also includes: cocking sled release lever 8 with compression spring 37; fire bar 18 with related fire bar linkage 17, fire bar lever 16, compression spring 36 and fire bar lever pivot axle 19; safety 32; arrow load lever 33, compression spring 34 and arrow tang 35 for holding a crossbow bolt or "arrow" between the lower barrel 9 and the upper barrel 20 and against the crossbow string 1 after cocking.

Figure 7:
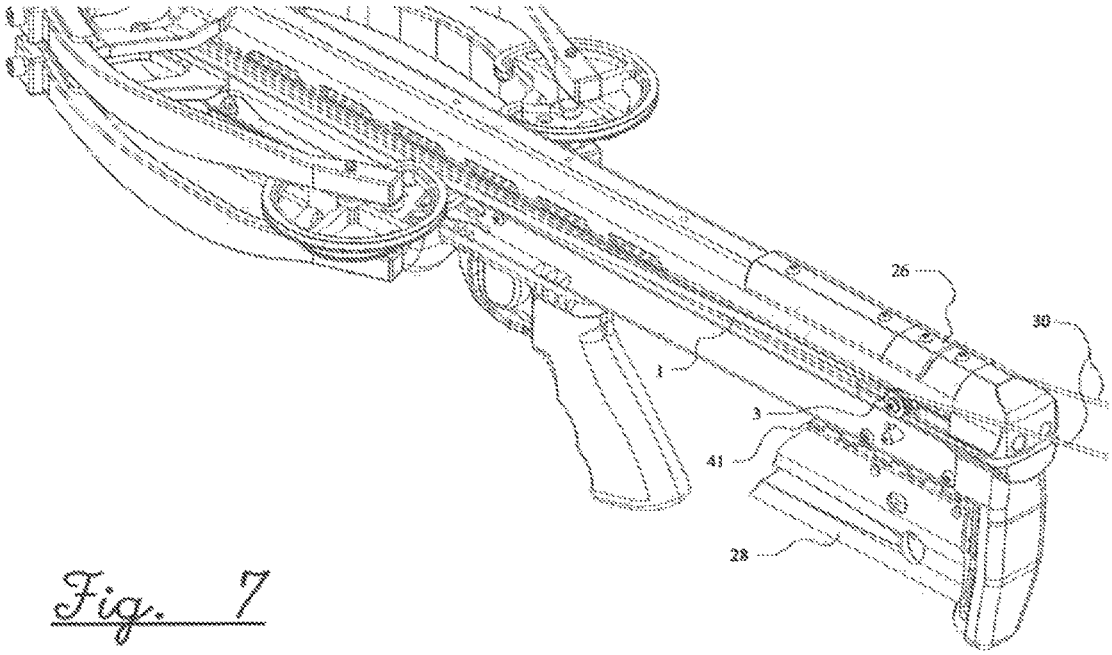
FIG. 7 is a left-side perspective view of an elongated-draw compact crossbow incorporating in FIG. 6; where the handles of the cocking rope have been pulled to draw the cocking sled and couple it to the arrow release near the butt end of the crossbow.
Figure 8:
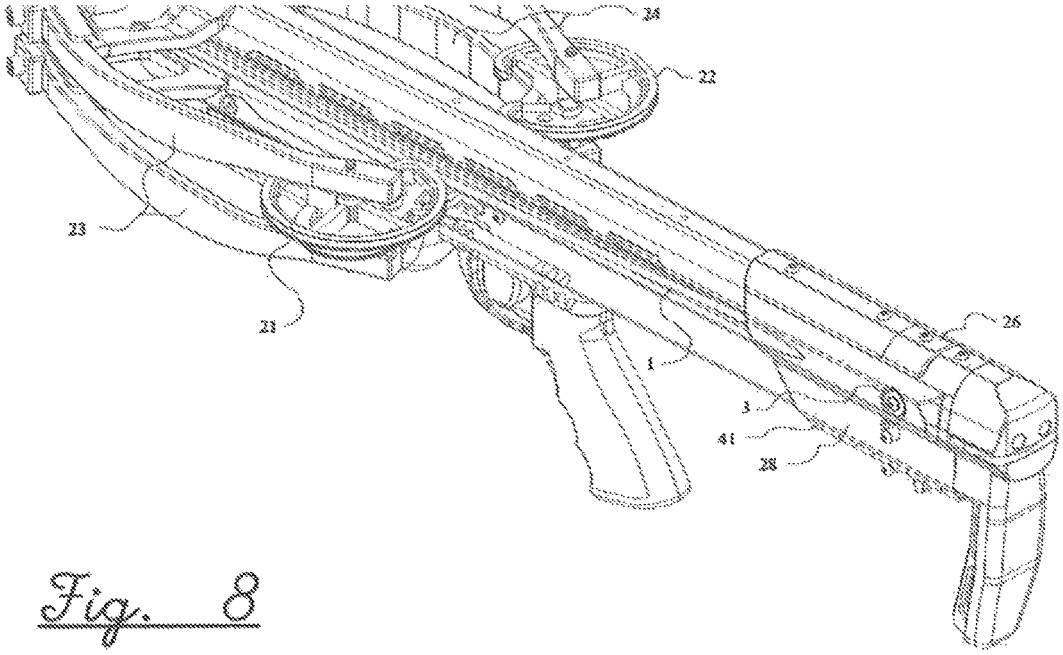
FIG. 8 is a left-side perspective view of the elongated-draw compact crossbow in FIG. 7; where the crossbow has been cocked, and where the cheek guard covers on the left and right sides of the crossbow have been rotated on respective hinges to the "closed" position to cover the crossbow string.
Figure 9:
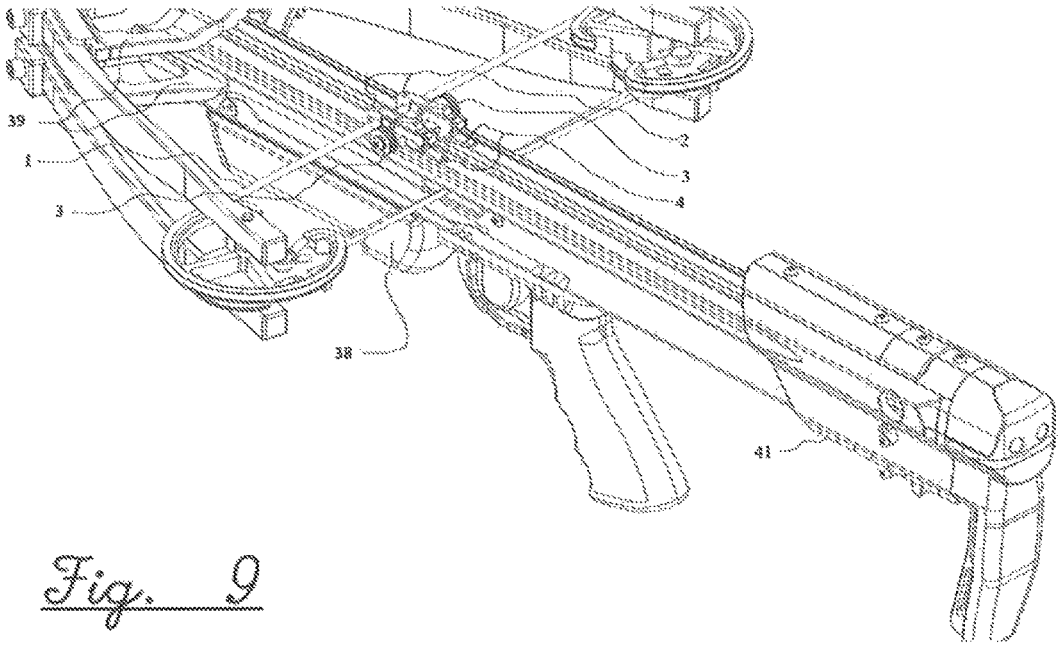
FIG. 9 is a left-side perspective view of an elongated-draw compact crossbow in FIG. 5; where the upper barrel of the crossbow has been removed, and where the cocking sled has been uncoupled from the arrow release and moved toward and latched to the crossbow string.
Figure 10:
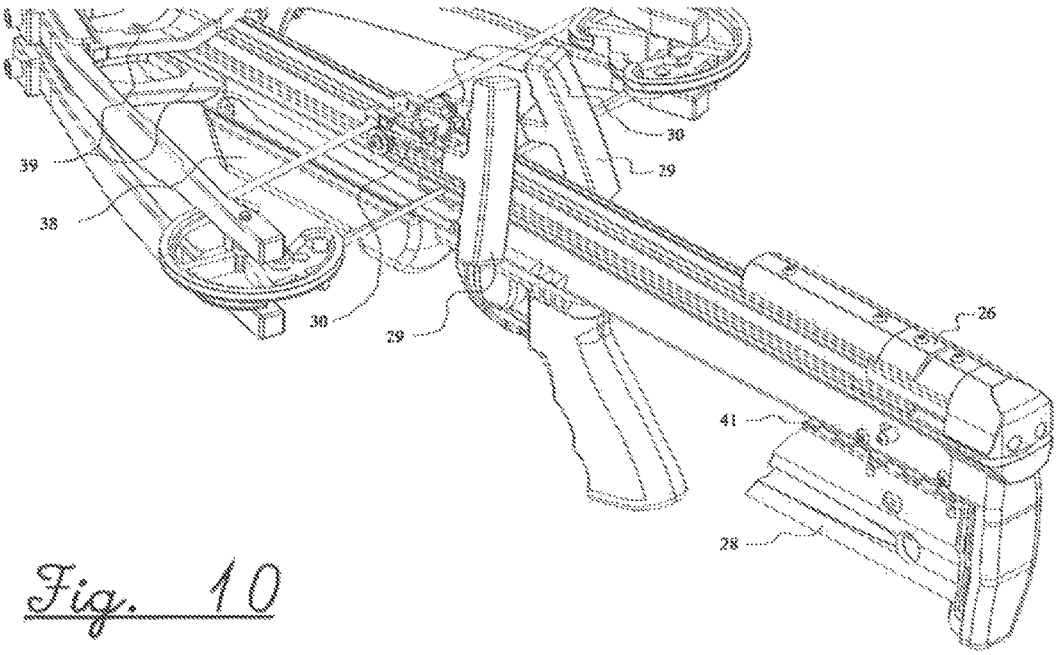
FIG. 10 is a left-side perspective view of the elongated-draw compact crossbow in FIG. 9; where the cheek guard covers on the left and right sides of the crossbow have been rotated on respective hinges to the "open" position, and where a cocking rope with two handles at respective ends is looped around the butt end of the crossbow and looped around a respective pulley of the cocking sled near a corresponding handle.
Figure 13:
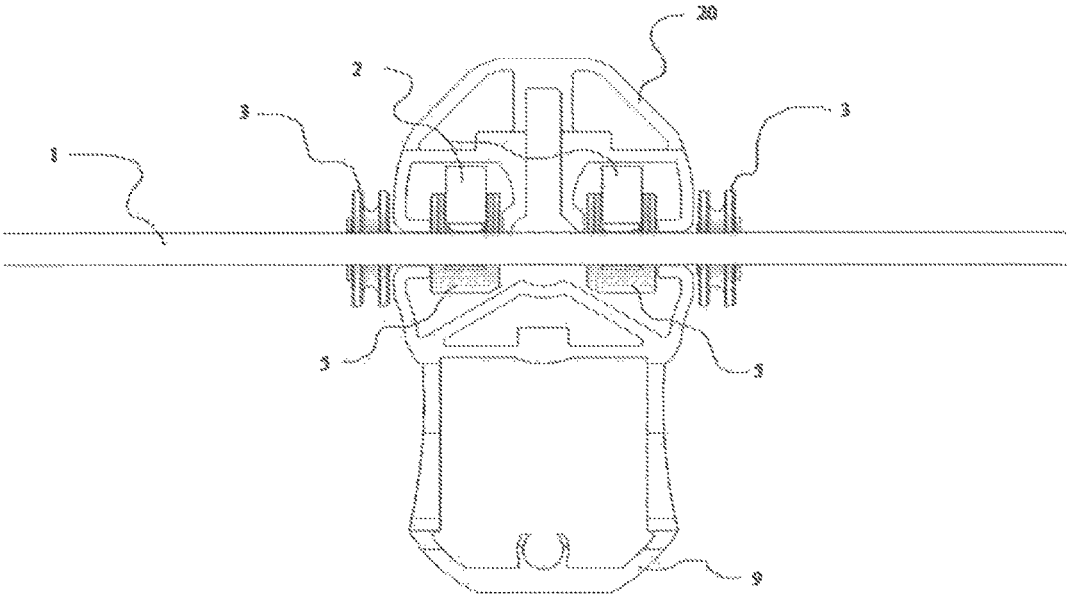
FIG. 13 is a partial front planar view of the muzzle end of the elongated-draw compact crossbow in FIG. 9; where the string latches of the cocking sled in the "open" position having been moved toward the crossbow string.
Figure 14:
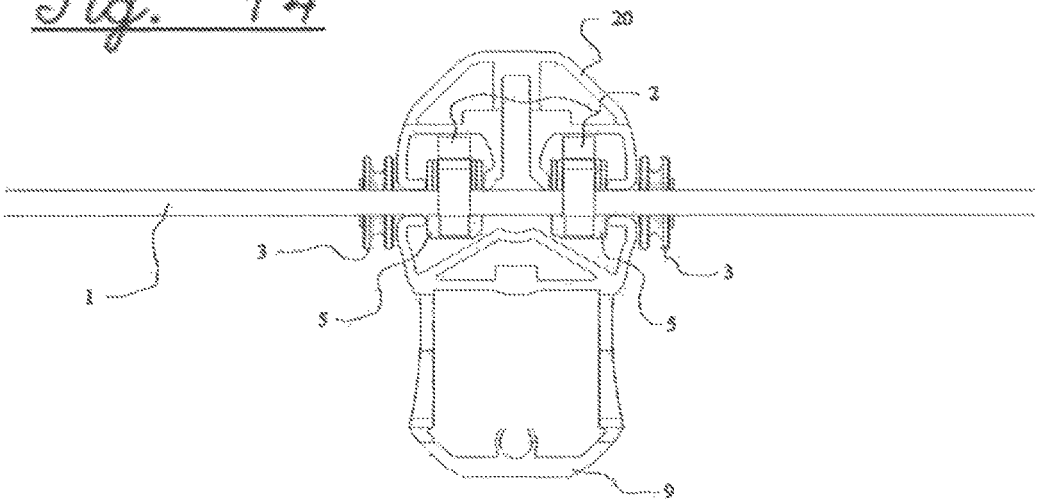
FIG. 14 is partial front planar view of the muzzle end of the elongated-draw compact crossbow in FIG. 9; where the string latches 2 of the cocking sled are in the "closed" position having been moved toward and latched to the crossbow string.

Referring next to FIG. 2, there is illustrated a left-side perspective view of the improved cocking sled 5 and arrow release 7 in FIG. 1; where the cocking sled 5 is disposed between the side rails of the lower barrel 9 of the elongated-draw compact crossbows in FIGS. 5-10, where the arrow release 7 is attached to the sides of the lower barrel 9 near the butt end of the crossbow, and where the cocking sled 5 is positioned next to the arrow release 7. The lower barrel 9 in FIG. 2, FIG. 13 and FIG. 14 includes rails on its top that serve as an arrow rest and includes left and right sides and bottom side below the rails that serve as a stock to which the forearm (or forend) 38, the grip 15 and the trigger housing 11 are attached. The upper barrel 20 in FIG. 13 and FIG. 14 includes rails opposite to the rails of the lower barrel 9. In FIG. 13 and FIG. 14, the lower barrel 9 and the upper barrel 20 together form openings for movement of the crossbow string 1 during cocking and release, openings for the movement of the cocking sled 5 backward and forward during cocking and re-cocking, and openings for insertion of a crossbow bolt at their muzzle end when the crossbow is cocked. In FIG. 9 and FIG. 10, the upper barrel 20 is removed. In an embodiment of the crossbow where the upper barrel 20 is not included, the cocking sled 5 may include leg portions, for example and without limitation, that extend under the rails of the lower barrel 9 (see FIG. 13 and FIG. 14) to retain the cocking sled 5 on the rails of the lower barrel 9 as it moves backward and forward during cocking and re-cocking.

During cocking, the string latches 2 of the cocking sled 5 are "closed" over the crossbow string 1, and the cocking sled 5 is pulled back by a cocking rope 30 for example, toward the arrow release 7 as illustrated in FIG. 2. As the cocking sled 5 is pulled and contacts the beveled leading surface of the tang 10 of the cocking sled release lever 8, the tang 10 of the cocking sled release lever 8 passes over the cocking sled 5 until it aligns with and is moved down into the rectangular hole 6 in cocking sled 5 due to the force of compression spring 37. When the tang 10 of the cocking sled release lever 8 is moved into the rectangular hole 6 in cocking sled 5, the cocking sled 5 is coupled to the arrow release 7 and securely held together by the force of the drawn crossbow string 1. In addition, the coupling of the cocking sled 5 to the arrow release 7 is enhanced and made more secure by the matching reverse angles (approximately five degrees) of the surface of the rectangular hole 6 and the opposing surface of the tang 10 of the cocking sled release lever 8. When the cocking sled 5 is coupled to the arrow release 7, the latch release sears 4 of the cocking sled 5 engage corresponding ends of the fire bar 18 as illustrated in more detail in FIG. 3 and FIG. 4. The cocked string 1 is latched and held by the coupled cocking sled 5 and arrow release 7 behind the front side of a shooter's face that rests against one of the cheek guard covers 28 (see FIG. 8) when aiming and shooting the crossbow.

Figure 3:
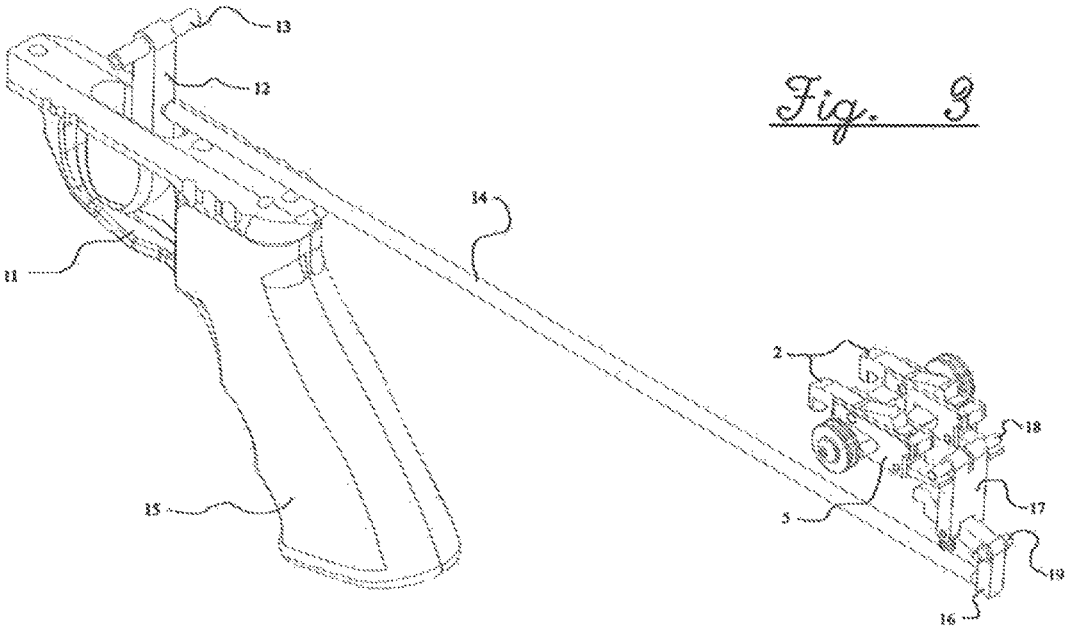
FIG. 3 is a left-side perspective view of the grip with trigger, the cocking sled, the fire bar in the arrow release, and other components related to trigger and fire bar of the elongated-draw compact crossbows in FIGS. 5-10; where the cocking sled and the arrow release are in the "cocked" position.

Referring next to FIG. 3, there is illustrated is a left-side perspective view of the grip 15 with trigger 12, the cocking sled 5, the fire bar 18 in the arrow release 7, and other components related to trigger 12 and fire bar 18 of the elongated-draw compact crossbows in FIGS. 5-10, where the cocking sled 5 and the arrow release 7 are in the "cocked" position and the trigger 12 is in its "at-rest" position. The grip 15 and trigger housing 11 is attached to the bottom of lower barrel 9 with screws. The trigger 12 is coupled to trigger pivot 13 and to a first end of trigger push rod linkage 14, and the second end of the trigger push rod linkage 14 is coupled to a first end of fire bar lever 16. The fire bar lever 16 is coupled on its opposite second end to the bottom of fire bar linkage 17. The fire bar lever 16 pivots on fire bar lever pivot axle 19 to move the fire bar linkage 17 and in turn the fire bar 18 down. When the crossbow is in the "cocked" position, the spring force of the compression spring 36 against second end of the fire bar lever 16 and in turn the fire bar linkage 17 holds the fire bar 18 up.

Figure 4:
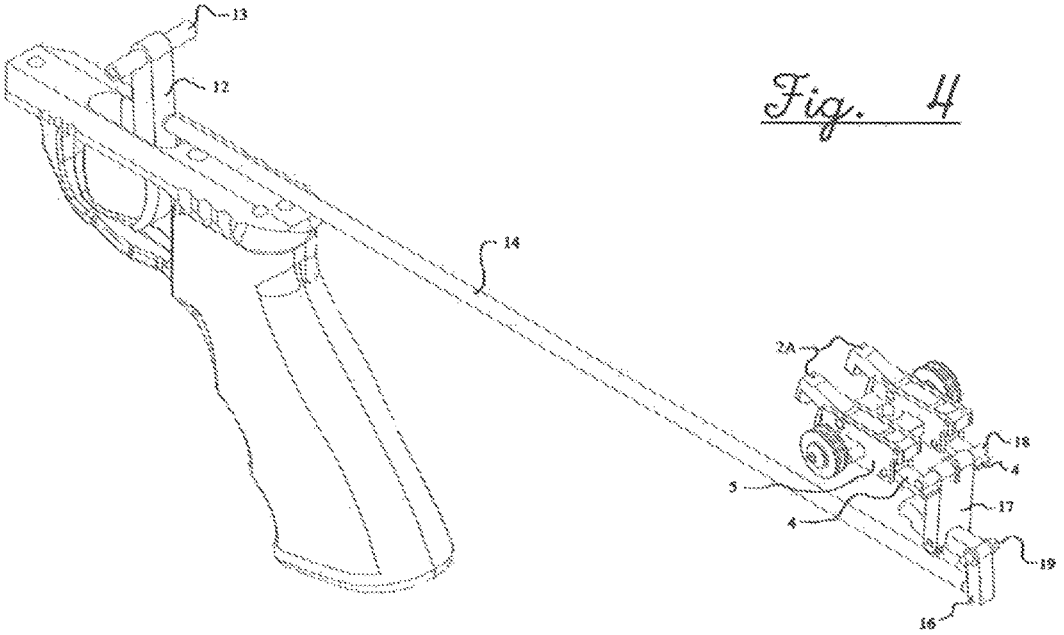
FIG. 4 is a left-side perspective view of the grip with trigger, the cocking sled, the fire bar in the arrow release, and other components related to the trigger and fire bar of the elongated-draw compact crossbows in FIGS. 5-10; where the cocking sled and the arrow release are coupled together and in the "released" position and the trigger is in its "pulled" position.

Referring next to FIG. 4, there is illustrated a left-side perspective view of the grip 15 with trigger 12, the cocking sled 5, the fire bar 18 in the arrow release 7, and other components related to the trigger 12 and fire bar 18 of the elongated-draw compact crossbows in FIGS. 5-10; where the cocking sled 5 and the arrow release 7 are coupled together and in the "released" position and the trigger 11 is in its "pulled" position. When the trigger 12 is pulled by the shooter to shoot a crossbow bolt that has been loaded into the crossbow, the trigger 12 rotates backward about trigger pivot 13 to move trigger push rod linkage 14 backward. When the trigger push rod linkage 14 moves backward, the fire bar lever 16 pivots on fire bar lever pivot axle 19 to move fire bar 18 down and in turn move the latch release sears 4 down to open the string latches 2, release the crossbow string 1, and shoot the loaded crossbow bolt. When the trigger 12 is released by the shooter, the compression spring 36 pushes the second end of the fire bar lever 16 up and the first end of the fire bar lever 16 moves forward to push the trigger push rod linkage 14 forward which in turn pushes the trigger 12 forward to its "at-rest" position. The string latches 2 of the cocking sled 5 remain in the "open" position.

Figure 5:
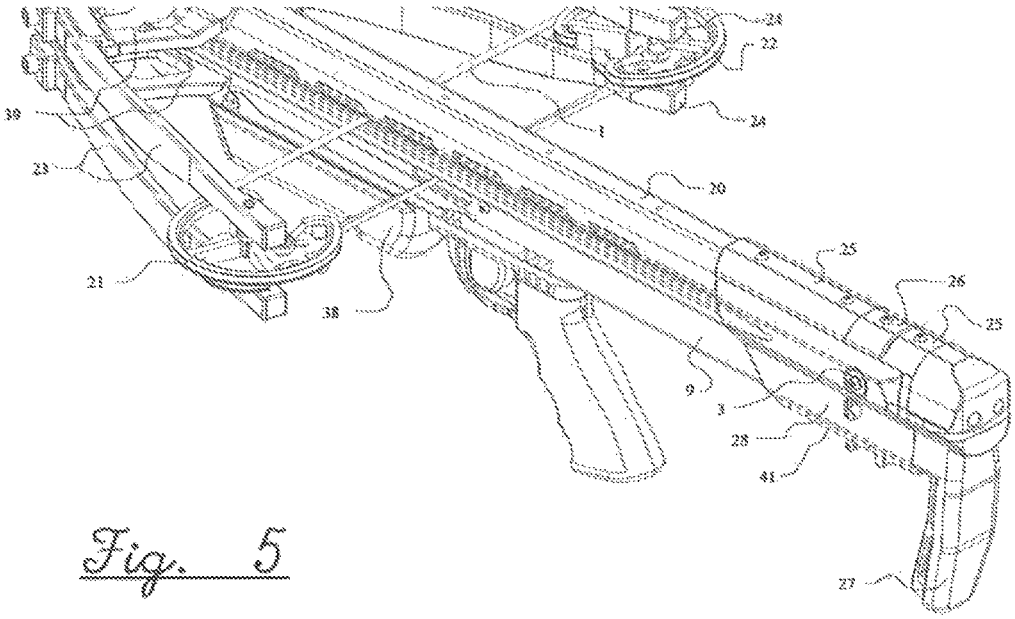
FIG. 5 is a left-side perspective view of an elongated-draw compact crossbow incorporating the improved cocking sled and arrow release in FIG. 1 and FIG. 2; where the cocking sled and the arrow release are coupled together and in the "released" position.

Referring next to FIG. 5, there is illustrated a left-side perspective view of an elongated-draw compact crossbow incorporating the improved cocking sled 5 and arrow release 7 in FIG. 1 and FIG. 2; where the cocking sled 5 and the arrow release 7 are coupled together and in the "released" position. The stationary cheek rest components 25 are attached to the top of the arrow release 7 by screws. As explained above, the arrow release 7 is attached to the left and right sides of the lower barrel 9 by screws. The movable cheek rest component 26 is attached by a screw to the top of the cocking sled release lever 8 and is held down against the top of the arrow release 7 by the spring force of compression spring 37 (see FIG. 1).

The crossbow in FIGS. 5-9 includes riser 39, left split limb 23 coupled to the riser 39, right split limb 24 coupled to the riser 39, left cam 21 coupled by an axle to the end of the left split limb 23, right cam 22 coupled by an axle to the right split limb 24, lower barrel 9 coupled to the riser 39 at its muzzle end, upper barrel 20 coupled to the riser 39 at its muzzle end, movable cocking sled 5 disposed in openings between the lower barrel 9 and the upper barrel 20 (see FIG. 13 and FIG. 14), stationary arrow release 7 coupled to the lower barrel 9 at its butt end, shoulder rest 27 (with a channel for the cocking rope 30) coupled to the arrow release 7 at the butt end of the crossbow, hand grip 15 with trigger housing 11 and trigger 12 coupled to the bottom of the lower barrel 9, forearm (or forend) 38 coupled to bottom of the lower barrel 9, right and left rotatable cheek guard covers 28 coupled to the lower barrel 9, stationary cheek rest components 25 coupled to the top of the upper barrel 20 and the top of the arrow release 7, movable cheek rest component 26 coupled to the top of the cocking sled release lever 8, and safety 32.

Figure 6:
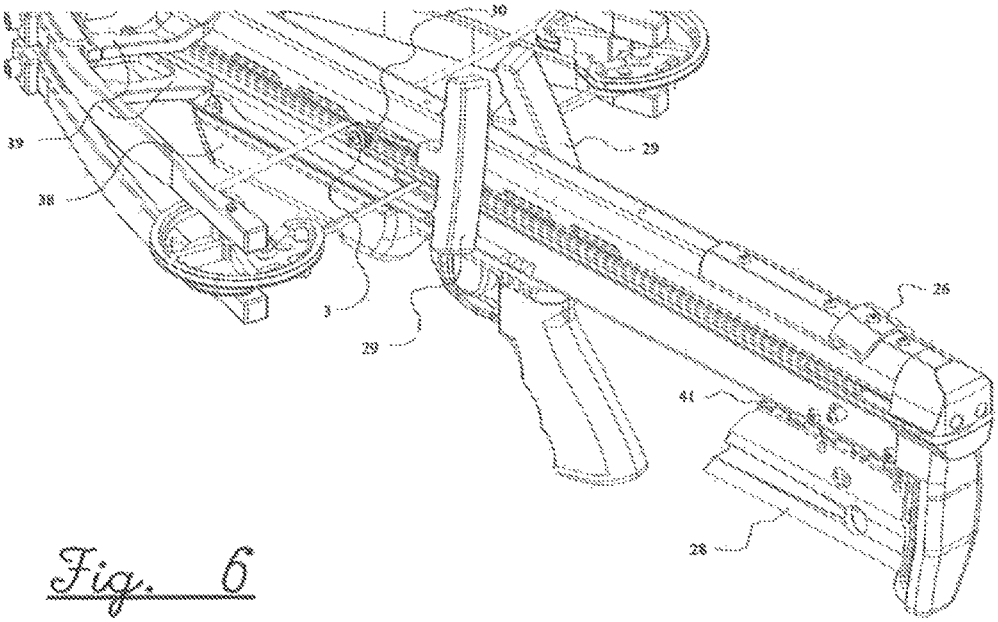
FIG. 6 is a left-side perspective view of the elongated-draw compact crossbow in FIG. 5; where the cocking sled has been uncoupled from the arrow release, moved toward the riser, and latched to the crossbow string, where the cheek guard covers on the left and right sides of the crossbow have been rotated on respective hinges to the "open" position, and where a cocking rope with two handles at respective ends is looped around the butt end of the crossbow and looped around a respective pulley of the cocking sled near a corresponding handle.

Referring next to FIG. 6, there is illustrated a left-side perspective view of the elongated-draw compact crossbow in FIG. 5; where the cocking sled 5 has been uncoupled from the arrow release 7, moved toward the riser 39, and latched to the crossbow string 1, where the cheek guard covers 28 on the left and right sides of the crossbow have been rotated on respective hinges 41 to the "open" position, and where a cocking rope 30 with two handles 29 at respective ends is looped around the butt end of the crossbow and looped around a respective pulley 3 of the cocking sled 5 near a corresponding handle 29. To release the cocking sled 5 from the arrow release 7, a shooter moves or pulls the cheek rest component 26 up and pushes the pulleys 3 forward toward and against the crossbow string 1 to latch the cocking sled 5 to the crossbow string 1. When a shooter lets go of the cheek rest component 26, the spring force of compression spring 37 (see FIG. 1) will move the cheek rest component 26 down against the top of the arrow release 7. According to another feature of the present disclosure, the axles of the left and right cams 21 and 22 are approximately 6 inches (less than 8 inches apart in other embodiments) apart when the crossbow is cocked and approximately 11 5/16" inches apart when the crossbow is relaxed or uncocked.

Figure 17:
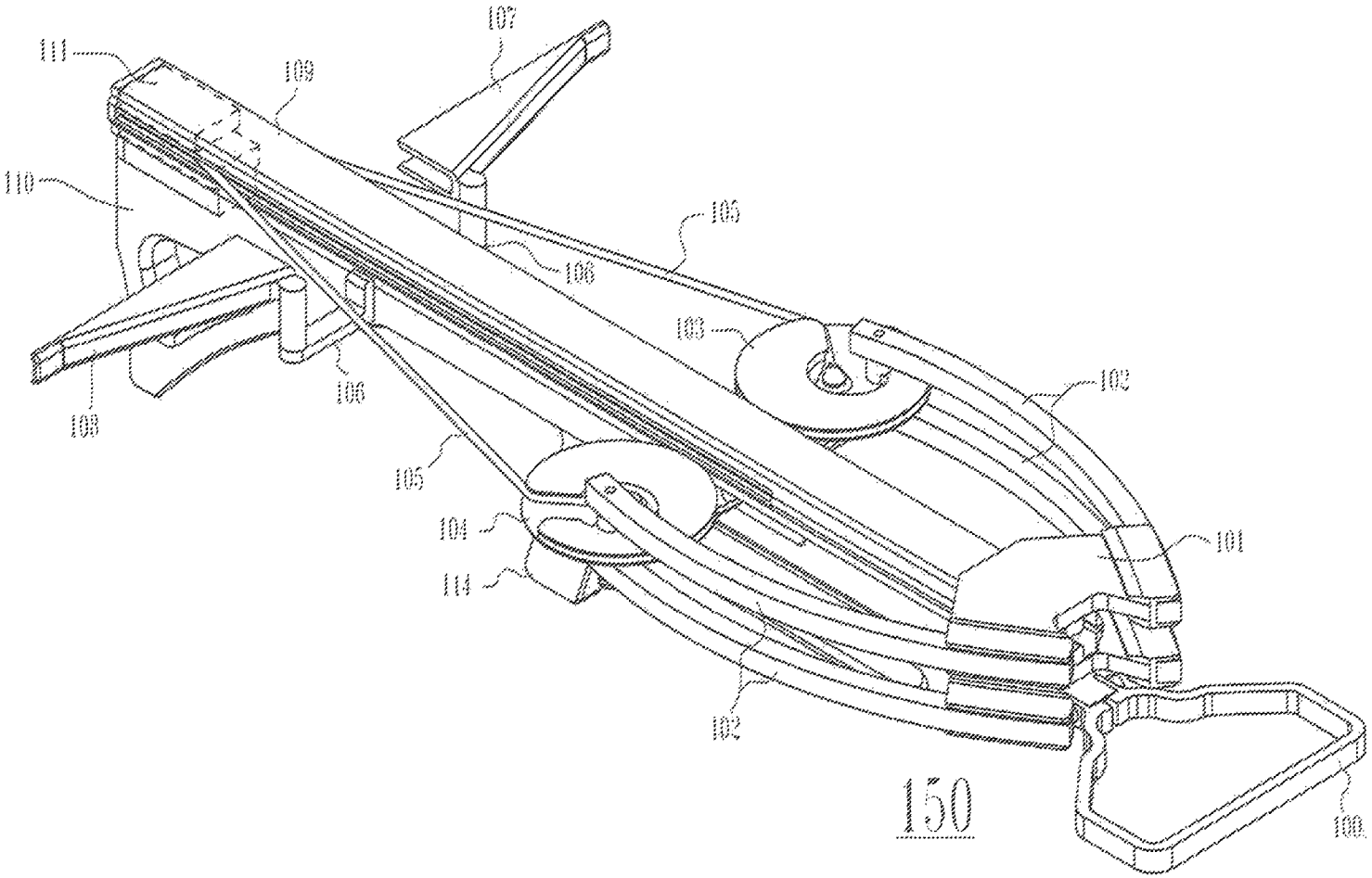
FIG. 17 is a right-side perspective view of an embodiment of an elongated-draw compact crossbow with the string in cocked position and the string covers in the open position that may advantageously utilize the novel cocking sled and arrow release embodying the present disclosure.

Referring next to FIG. 7, there is illustrated is a left-side perspective view of an elongated-draw compact crossbow incorporating in FIG. 6; where the handles 29 of the cocking rope 30 have been pulled to draw the cocking sled 5 and couple it to the arrow release 7 near the butt end of the crossbow. To facilitate cocking of the crossbow in FIG. 7, a stirrup 100 as shown in FIG. 17 may be coupled to the riser 39, and a shooter places the stirrup against the ground and puts his foot within the stirrup when cocking the string 1 with the cocking rope 30. As the cocking sled 5 is pulled and contacts the beveled leading surface of the tang 10 of the cocking sled release lever 8, the tang 10 passes over the cocking sled 5 until it aligns with and is moved into the rectangular hole 6 in cocking sled 5 due to the force of compression spring 37 (see FIG. 1 and FIG. 2). When tang 10 of the cocking sled release lever 8 is moved into the rectangular hole 6 in cocking sled 5, the cheek rest component 26 also is moved down against the top of the arrow release 7. Once the tang 10 of the cocking sled 5 is moved into the rectangular hole 6 in cocking sled 5, the cocking sled 5 is coupled to and securely held by the arrow release 7, and the cocking rope 30 can be removed.

Referring next to FIG. 8, there is illustrated is a left-side perspective view of the elongated-draw compact crossbow in FIG. 7; where the crossbow has been cocked, and where the cheek guard covers 28 on the left and right sides of the crossbow have been rotated on respective hinges 41 to the "closed" position to cover the crossbow string 1. A crossbow bolt may be inserted from the muzzle ends of the lower barrel 9 and upper barrel 20 (see FIGS. 13 and 14). The arrow load lever 33 may be moved rearward to allow the crossbow bolt to move back further against the crossbow string 1. Once cocked and loaded, the safety 32 may be moved forward and the trigger pulled to shoot the loaded crossbow bolt.

Referring next to FIG. 9 and FIG. 10, there is illustrated a left-side perspective view of an elongated-draw compact crossbow in FIG. 6; where the upper barrel 20 of the crossbow has been removed, and where the cocking sled 5 has been uncoupled from the arrow release 7 and moved toward and latched to the crossbow string 1. The cheek guard covers 28 in FIG. 9 are in the "closed" position. In FIG. 10, the cheek guard covers 28 on the left and right sides of the crossbow have been rotated on respective hinges 41 to the "open" position (down so parallel to respective sides of the lower barrel 9) so that the cocking rope 30 with two handles 29 at respective ends may looped around the butt end of the crossbow and looped around a respective pulley 3 of the cocking sled 5 to enable a shooter to pull back the cocking sled 5 and couple it to the arrow release 7 to cock the crossbow. In embodiments of the crossbow in FIG. 9 and FIG. 10 that only include the lower barrel 9, the cocking sled 5 may include two leg portions, for example and without limitation, that extend under respective rails of the lower barrel 9 in FIG. 13 and FIG. 14 to retain the cocking sled 5 on the rails of the lower barrel 9 as it moves forward and backward during cocking and re-cocking.

Referring next to FIG. 11 and FIG. 12, there is illustrated a left-side perspective view of an elongated-draw compact crossbow in FIG. 9; where the string latches 2 of the cocking sled 5 are in the "open" position in FIG. 11 and in the "closed" position in FIG. 12, and where the latch release sears 4 are in the "down" position in FIG. 11 and in the "horizontal" or "up" position in FIG. 12. As the "open" string latches 2 of the cocking sled 5 are pushed forward against the crossbow string 1 by a shooter, the back portion of the U-shaped string latches 2 is pushed against the crossbow string causing the string latches to snap "closed" over the string 1. When the string latches 2 snap "closed", the latch release sears 4 move from the "down" position in FIG. 11 and to the "horizontal" or "up" position in FIG. 12.

Referring next to FIG. 13 and FIG. 14, there is illustrated a partial front planar view of the muzzle end of the elongated-draw compact crossbow in FIG. 9; where in FIG. 13 the string latches 2 of the cocking sled 5 in the "open" position having been moved toward the crossbow string 1, and where in FIG. 14, the string latches 2 of the cocking sled 5 are in the "closed" position having been moved toward and latched to the crossbow string 1. The lower barrel 9 in FIG. 13 and FIG. 14 includes rails on its top that serve as an arrow rest and includes left and right sides and bottom side below the rails that serve as a stock to which the forearm (or forend) 38, the grip 15 and the trigger housing 11 are attached. The upper barrel 20 in FIG. 13 and FIG. 14 includes rails opposite to the rails of the lower barrel 9. In FIG. 13 and FIG. 14, the lower barrel 9 and the upper barrel 20 together form openings (or channels) for movement of the crossbow string 1 during cocking and release, openings (or channels) for the movement of the cocking sled 5 backward and forward during cocking and re-cocking, and openings (or channels) for insertion of a crossbow bolt at their muzzle end when the crossbow is cocked. In an embodiment of the crossbow where the upper barrel 20 is not included as in FIG. 9 and FIG. 10, the cocking sled 5 may include two leg portions, for example and without limitation, that extend under respective rails of the lower barrel 9 in FIG. 13 and FIG. 14 to retain the cocking sled 5 on the rails of the lower barrel 9 as it moves backward and forward during cocking and re-cocking.

Figure 15:
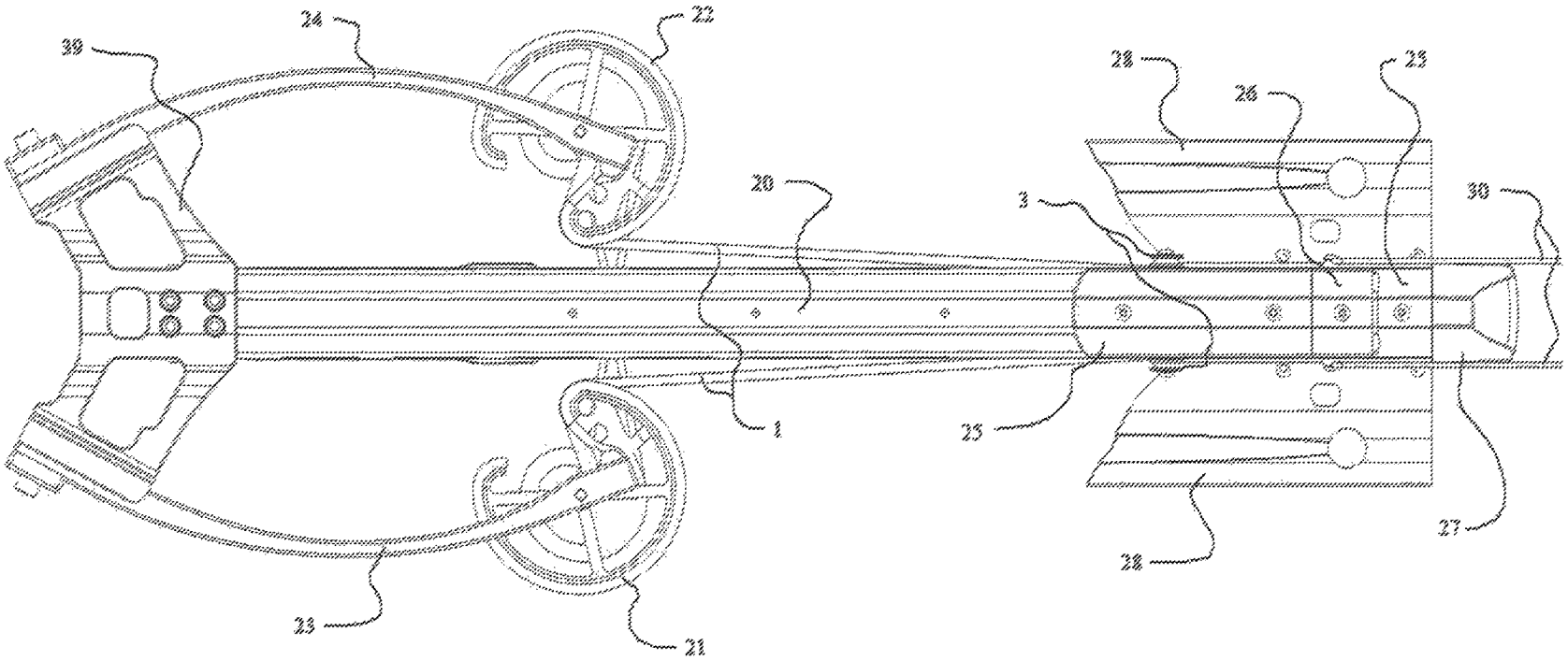
FIG. 15 is a top planar view of the elongated-draw compact crossbow in FIG. 7; where the cocking sled is coupled to and securely held by the arrow release, where the crossbow string has been cocked, and where the cheek guard covers on the left and right sides of the crossbow have been rotated on respective hinges to a "horizontal" position.

Referring next to FIG. 15, there is illustrated a top planar view of the elongated-draw compact crossbow in FIG. 7; where the cocking sled 5 is coupled to and securely held by the arrow release 7, where the crossbow string 1 has been cocked, and where the cheek guard covers 28 on the left and right sides of the crossbow have been rotated on respective hinges 41 to a "horizontal" position. The cocked crossbow string 1 is latched by the cocking sled 5 which is coupled to and securely held by the arrow release 7. The cocked crossbow string 1 is just in front of the pulleys 3. The cheek guard covers 28 will be rotated on respective hinges 41 from the "horizontal" position up to the "closed" position where they cover the cocked crossbow string 1 to prevent injury to the user's face should the crossbow string 1 break or otherwise come loose. A shooter's face will rest against one of the cheek guard covers 28 (left cover 28 for right-hand shooters, and right cover 28 for left-hand shooters) when aiming and shooting the crossbow. Furthermore, when a shooter's face is resting against one of the cheek guard covers 28, the cocked string 1 latched and held by the cocking sled 5 and arrow release 7 is behind the front side of the shooter's face. In an embodiment of the crossbow in FIG. 15: the distance of the from the tip of muzzle end of the riser 39 to the butt end of the shoulder rest 27 is approximately twenty-five inches (may be any suitable length in other embodiments); the power stroke is approximately fourteen inches (may be between ten inches and twenty inches in other embodiments); and the distance between the axles of the left and right cams 21 and 22 are approximately six inches apart (less than eight inches apart in other embodiments) when the crossbow is cocked and approximately 11 5/16 inches apart when the crossbow is relaxed or uncocked. Also, the respective outside perimeters of the left and right cams 21 and 22 are approximately 4 inch (less than two inches in other embodiments) from the sides of lower barrel 9 and upper barrel 20 when the string 1 is cocked (or may extend into appropriately sized openings between lower barrel 9 and upper barrel 20 in other embodiments).

Referring next to FIG. 16, there is illustrated a left-side perspective view of the arrow release 7 in FIG. 2 together with the left-side housing cover 40 of the arrow release 7 not shown in FIG. 2. The cheek guard covers 28 on the left and right sides of the crossbow have been rotated on respective hinges 41 to a "horizontal" position.

Referring next to FIG. 17, there is illustrated a right-side perspective view of an embodiment of an elongated-draw compact crossbow 150 with the string 105 in cocked position and right and left string covers 108 and 107 in the open position, that may advantageously utilize the novel cocking sled 5 and arrow release 7 embodying the present disclosure. The crossbow 150 includes a riser 101, stirrup 100, right and left split limbs 102 each having a first end coupled to the riser 101, right and left cams 104 and 103 with axles coupled to respective second ends of the right and left split limbs 102, string 105 and harness coupled to right and left cams 104 and 103, and a rifle-type stock 110 with a substantially rectangular-shaped barrel 109 (may be tubular or any suitable shape for holding a crossbow bolt or "arrow") having a muzzle end and butt end and being coupled to the stock 110. The muzzle end of the stock 110 and the barrel 109 are coupled between the top portion and bottom portion of the riser 101. The rifle-type stock 110 and the barrel 109 may be one piece or separate pieces of the same or different materials attached or otherwise coupled to one another. The rifle-type stock 110 includes a forearm 117, a pistol-type grip 114, a trigger 115 (see FIG. 5), and a shoulder rest. The barrel 109 is comprised of an elongated track with a slot in each side extending from near the muzzle end to near the butt end of the barrel 109 for allowing the string 105 and harness to pass through the barrel 109 when uncocked, during cocking and release. The two string covers 108 and 107 shown in the open position are coupled by respective brackets 106 to the stock 110 near the butt end of the barrel 109. The string covers 108 and 107 may rotate on their respective brackets 106 to a closed position (up against the barrel 109) to cover the string 105 in the cocked position (drawn back and captured by release 111). The string covers 108 and 107 rotate on their respective brackets 106 to cover the portion of string 105 that is behind the front side of a user's face when aiming and shooting. The crossbow 150 includes two string covers 108 and 107 so that it may be shot either right handed or left handed. In other embodiments, the crossbow 150 need only include one string cover 108 or 107 for a right-hand only or left hand only crossbow, respectively. The string 105 may be drawn back to the cocked position by hand, a cocking rope 30, or a crank-type cocking device (suitably attached to the shoulder rest of the stock 110 for example). A conventional string release 111 (shown in dashed lines in FIG. 17) is coupled to the barrel 109 near the butt end of the stock 110 so that it is behind the front side of a shooter's face when aiming and shooting. The string release 111 is also coupled to the trigger 115 disposed near grip 114. In other embodiments of the crossbow 150, the string release 111 may be coupled at any point to the barrel 109 between the butt end thereof and the front side of a shooter's face when aiming and shooting. A standard crossbow bolt with a nock and a hunting or field tip may be inserted into the barrel 109 at the muzzle end when the crossbow 150 is cocked and is captured by the string release 111 at the butt end of the barrel 109 (a spring may assert a force against the nock end of the bolt to keep it in place in the barrel 109). The barrel 109 may be similar to the tubular barrel illustrated and described in my U.S. Pat. Nos. 5,119,797, 6,142,133, 6,752,136, 6,752,136 and 7,823,572, incorporated herein in their entirety by reference. The string release 111 may be any conventional string release used in crossbows such as, for example, the string release illustrated and described in my U.S. Pat. Nos. 5,119,797 and 9,004,053, incorporated herein in their entirety by reference.

Figure 18:
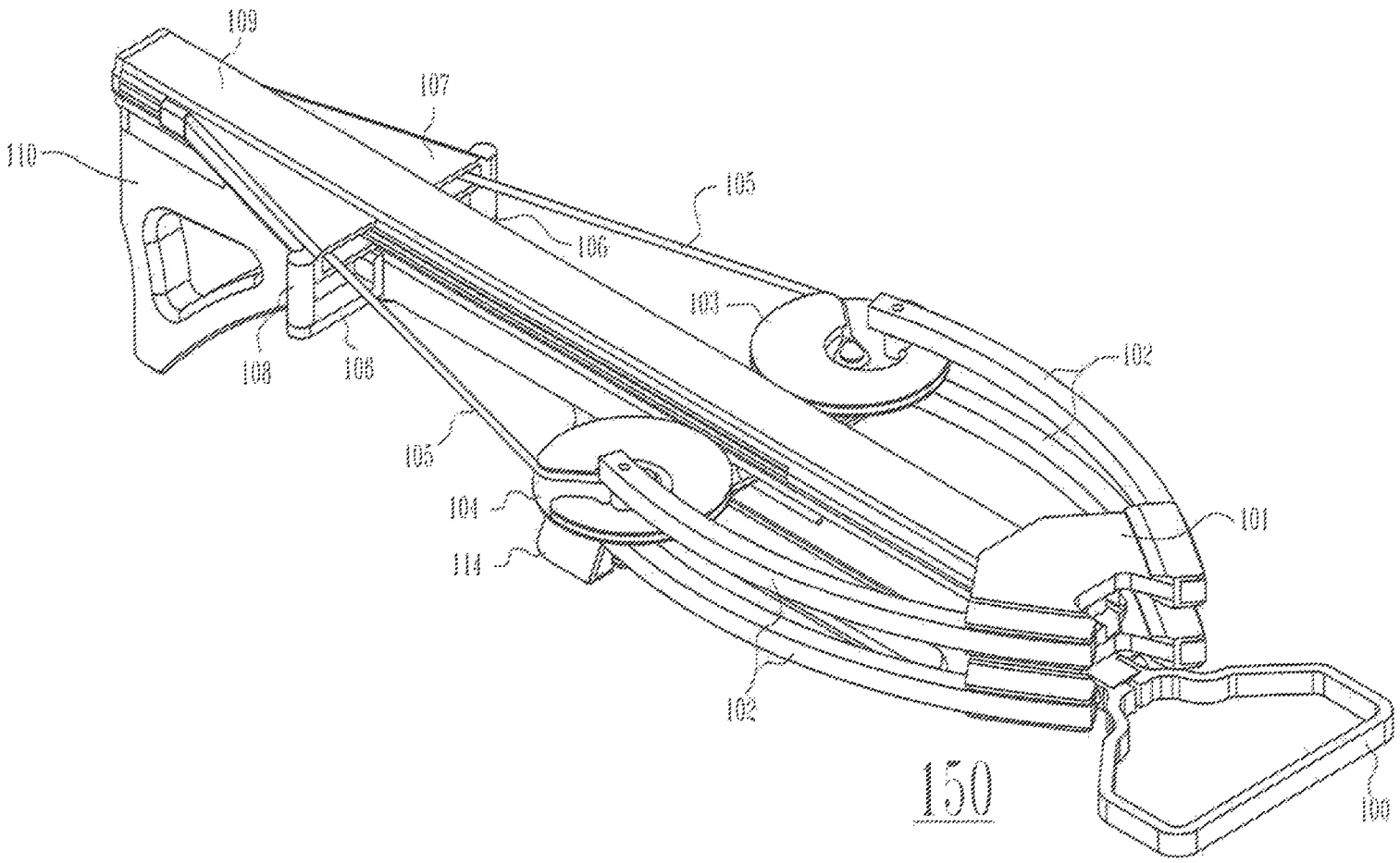
FIG. 18 is a right-side perspective view of the elongated-draw compact crossbow in FIG. 17 with the string in cocked position and the string covers in the closed position.

Referring next to FIG. 18, there is illustrated a right-side perspective view of the crossbow 150 in FIG. 17, showing the string 105 in cocked position and the string covers 108 and 107 in the closed position. The string covers 108 and 107 in FIGS. 1 and 2 have end tabs at the free end, U-shaped channels and cylindrical end tubes that slip over corresponding cylindrical rods of the brackets 106. In order to cock the crossbow 150, a shooter places it against the ground and puts his foot within the stirrup 100. The shooter may then draw the string 105 by hand or with a rope cocking device against the force of the crossbow limbs 102 to store energy in the crossbow limbs 102. When the string 105 is fully drawn, it is held in the cocked position by the string release 111. The string covers 108 and 107 may now be rotated toward the barrel 109 until their respective end tabs rest against the sides of the barrel 109. The string covers 108 and 107 enclose but do not touch the string 105 when closed. Since the string 105 is covered by the string covers 108 and 107, the string 105 will not touch or otherwise contact the shooter's face on release of a bolt from crossbow 150 or in the unlikely event that the string 105 should break or otherwise separate from the cams 104 and 103. To insure that string covers 108 and 107 do not open or rattle when the string 105 is released by pulling the trigger 115, retaining springs, dips, snaps, Velcro strips, magnets, or other suitable capture devices may be incorporated by a person skilled in the art to hold the string covers 108 and 107 in the closed position against respective sides of the barrel 109. In other embodiments of the crossbow 150, string covers 108 and 107 may be mounted on respective hinges (see hinge 112 in FIG. 25 for example) on the side of the stock 110 and rotate up to cover the cocked string 105.

Figure 19:
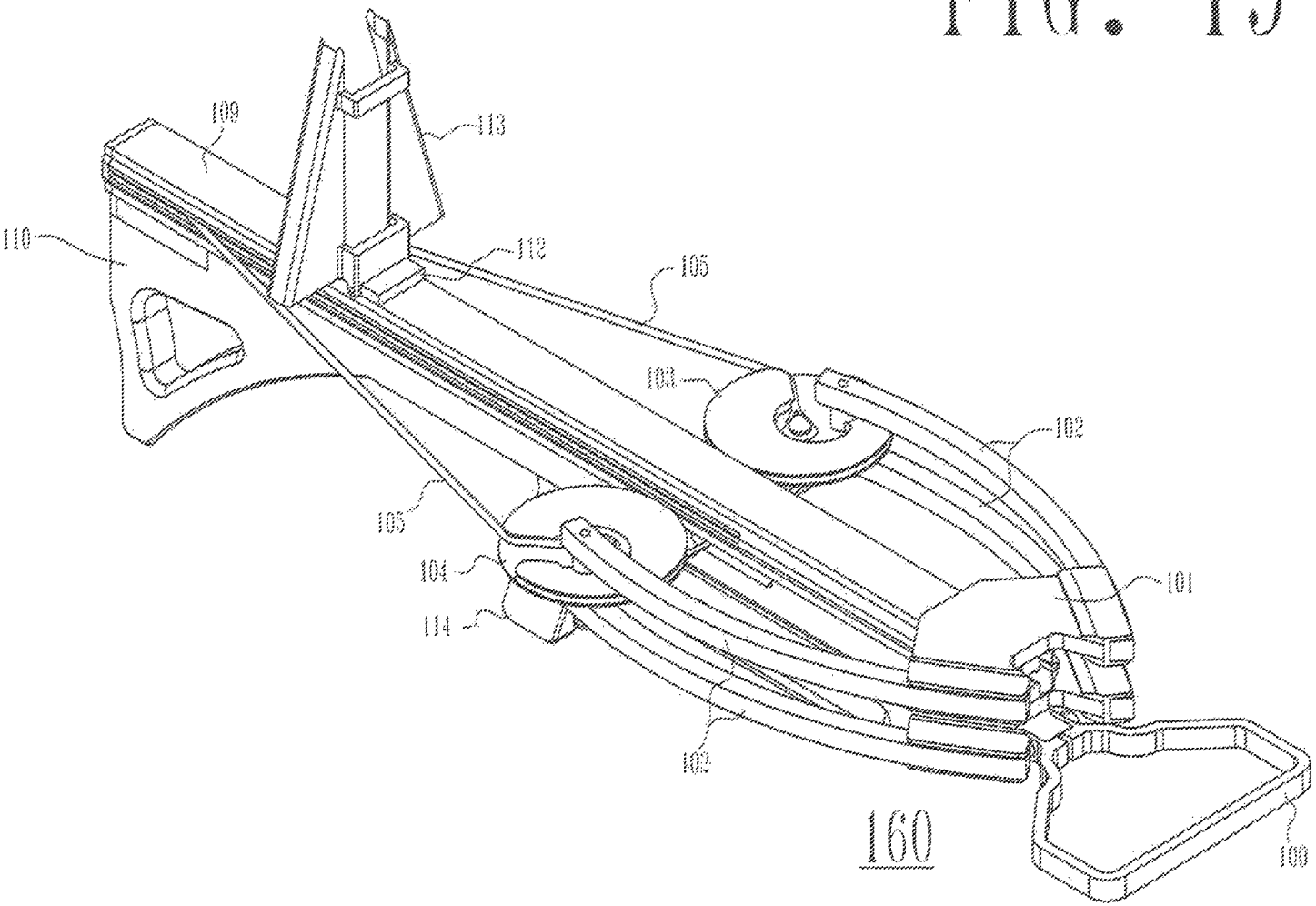
FIG. 19 is a right-side perspective view of another elongated-draw compact crossbow with the string in cocked position and the string cover in the open position that may advantageously utilize the novel cocking sled and arrow release embodying the present disclosure.

Referring next to FIG. 19, there is illustrated a right-side perspective view of another embodiment of an elongated-draw compact crossbow 160 with the string 105 in cocked position and the string cover 113 in the open position, that may advantageously utilize the novel cocking sled and arrow release embodying the present disclosure. Components of the crossbow 160 in FIGS. 19, 20 and 21 that are the same as corresponding components of the crossbow 150 in FIG. 17 have been given the same references numbers. The string cover 113 is coupled to the hinge 112 on the top of barrel 109 and rotates on the hinge 112 up to the open position so that the string 105 may be cocked.

Figure 20:
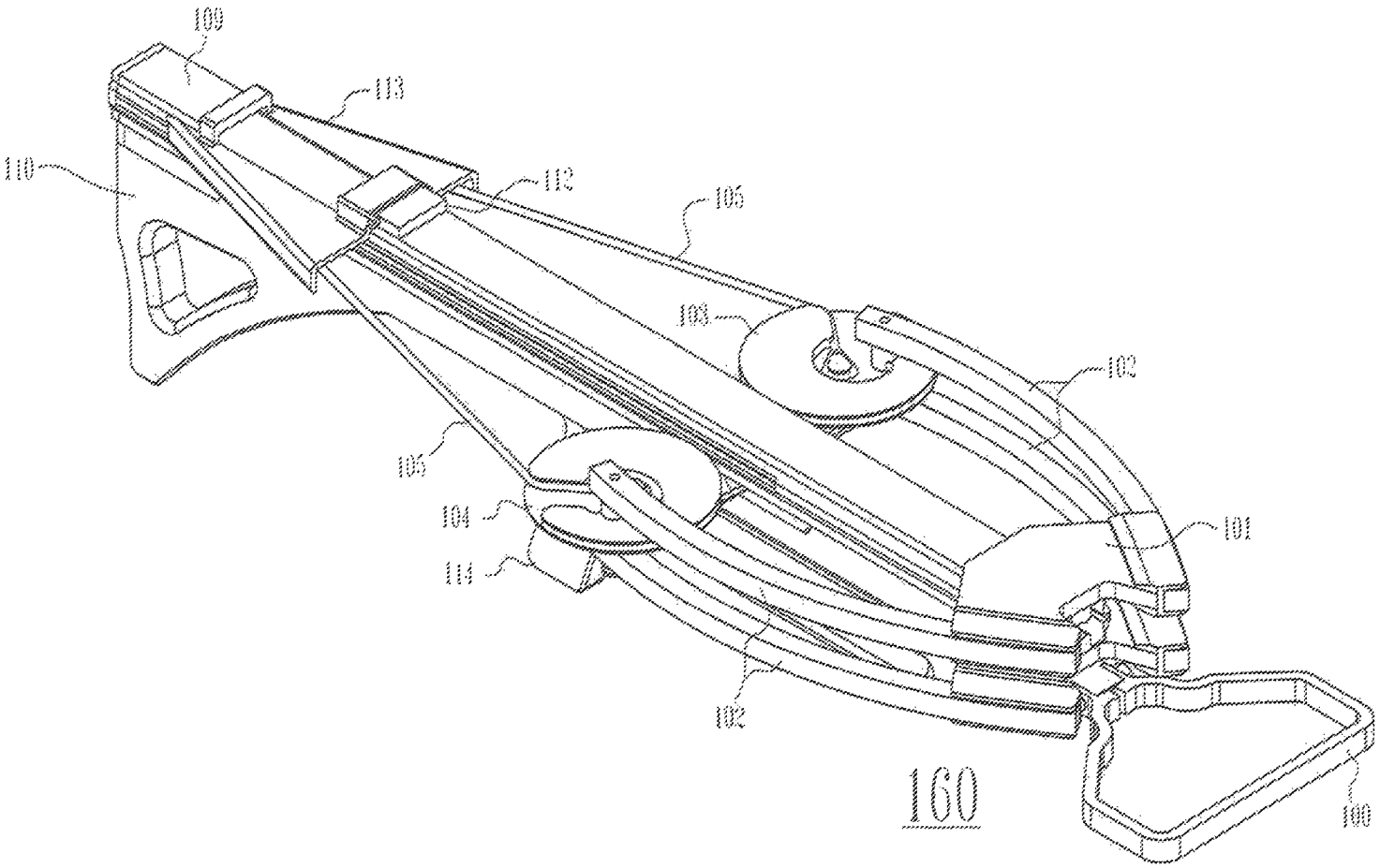
FIG. 20 is a right-side perspective view of the elongated-draw compact crossbow in FIG. 19 with the string in cocked position and the string cover in the closed position.

Referring now to FIG. 20, there is illustrated a right-side perspective view of the elongated-draw compact crossbow 160 in FIG. 19, with the string 105 in cocked position and the string cover 113 in the closed position. The string cover 113 has right and left cover portions. Once the string 105 is cocked, the string cover 113 may be rotated on the hinge 112 down to rest against the top of the barrel 109 so that the right and left cover portions extend down over the string 105.

Figure 21:
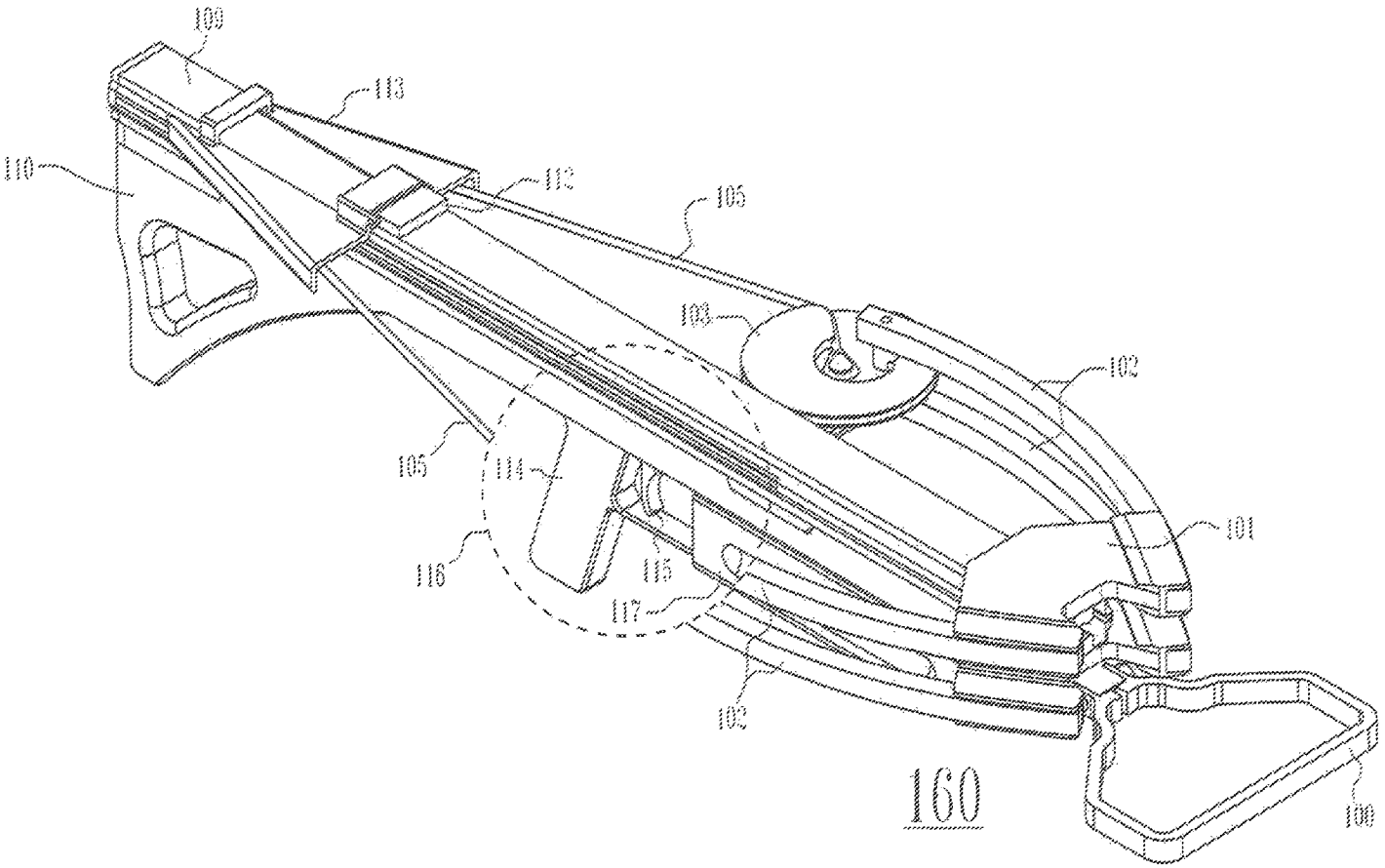
FIG. 21 is a right-side perspective view of the elongated-draw compact crossbow in FIG. 20, with the string in cocked position and the string cover in the closed position; where a cut-away exposes the pistol grip and trigger.

Referring now to FIG. 21, there is illustrated is a right-side perspective view of the elongated-draw compact crossbow 160 in FIG. 20, with the string 105 in cocked position and the string cover 113 in the closed position, where a cut-away exposes the pistol grip 114, the trigger 115 and a portion of the forearm 117 (or forend) of stock 110. In FIG. 17, FIG. 18, FIG. 19 and FIG. 20, the pistol grip 114, the trigger 115 and the forearm 117 of stock 110 are covered at least in part by the right cam 104 and right split limbs 102.

According to a feature of the crossbow 150 illustrated in FIGS. 17 and 18 and the crossbow 160 illustrated in FIGS. 19, 20 and 21, the respective outside perimeters of the right and left cams 104 and 103 are relatively close to the barrel 109 when the string 105 is cocked. For example, the respective outside perimeters of the right and left cams 104 and 103 may be within one-sixteenth inch to two inches from the barrel 109 when the string 105 is cocked. In other embodiments, the respective perimeters of the right and left cams 104 and 103 of crossbows 150 and 160 may extend partially into the string slot in the barrel 109 provided that the portion of the string slot adjacent to the right and left cams 104 and 103 is made large enough to fit them when the string is cocked.

Thus, a novel moveable cocking sled and arrow release for crossbows described above and illustrated by the embodiments in the attached drawings is safer and more reliable than prior art string release assemblies. Furthermore, my novel crossbow cocking sled and arrow release can be advantageously utilized in the crossbows illustrated in the drawings as well as in other suitable conventional crossbows.

While particular embodiments of the present disclosure have been shown and described, modifications may be made to the embodiments by routineers skilled in the art. It is therefore intended in the appended claims to cover all such modifications which fall within the true spirit and scope of the present disclosure.

What is claimed is:

1. An moveable cocking sled and an arrow release of a crossbow; the crossbow comprising a first limb and a second limb, the first limb and the second limb each having a first end and a second end, a riser coupled to the first end of the first limb and the first end of the second limb, a first cam with an axle coupled to the second end of the first limb, the first cam having an outside perimeter, a second cam with an axle coupled to the second end of the second limb, the second cam having an outside perimeter, a string extending between the first cam and the second cam, a lower barrel having side rails and a channel, the lower barrel having a muzzle end and a butt end, and the muzzle end of the lower barrel coupled to the riser; the moveable cocking sled and the arrow release further comprising:

the movable cocking sled moving along the rails of the lower barrel and adapted to latch to the string when moved against the string, and the moveable cocking sled being retained by the channel of the lower barrel;

the arrow release coupled to and held stationary by the lower barrel near the butt end of the lower barrel, the arrow release adapted to couple to and hold the movable cocking sled when the cocking sled is latched to the string and moved along the rails of the lower barrel to cock the string, and the cocked string being behind the front side of a shooter's face when aiming and shooting; and a cover coupled to the lower barrel near the butt end thereof and adapted to rotate toward the lower barrel to cover the string near a shooter's face after the string is cocked.

2. The moveable cocking sled and the arrow release of a crossbow according to claim 1, wherein moveable cocking sled further includes a left pulley and a right pulley that each rotate on respective axles, wherein the string may be cocked by a cocking rope that engages the left pulley and the right pulley.

3. The crossbow according to claim 1, wherein the lower barrel has two sides, wherein the cover has a hinge coupled to one of the two sides of the lower barrel, and wherein the cover rotating on the hinge toward the one of the two sides of the lower barrel to cover the string when the string is cocked.

4. The moveable cocking sled and the arrow release of a crossbow according to claim 1, wherein the lower barrel has two sides, wherein the cover has a hinge coupled to one of the two sides of the lower barrel, and wherein the cover rotating on the hinge toward the one of the two sides of the lower barrel to cover the string when the string is cocked; and wherein the crossbow further includes a second cover having a hinge coupled to the other one of the two sides of the lower barrel, and the second cover rotating on its hinge toward the other one of the two sides of the lower barrel to cover the string when the string is cocked.

5. The moveable cocking sled and the arrow release of a crossbow according to claim 1, wherein the crossbow further comprises:

a shoulder rest coupled to the butt end of the lower barrel; and a hand grip coupled to the lower barrel, the hand grip including a trigger coupled to the arrow release.

6. The moveable cocking sled and the arrow release of a crossbow according to claim 1, wherein the respective outside perimeters of the first cam and the second cam being disposed within two inches of the lower barrel when the string is cocked.

7. A crossbow, comprising:

a first limb and a second limb, the first limb and the second limb each having a first end and a second end;

a riser coupled the first end of the first limb and the first end of the second limb;

a first cam with an axle coupled to the second end of the first limb, the first cam having an outside perimeter;

a second cam with an axle coupled to the second end of the second limb, the second cam having an outside perimeter;

a string extending between the first cam and the second cam;

a movable cocking sled adapted to latch to the string when moved against the string;

an arrow release adapted to couple to and hold the movable cocking sled when the cocking sled is latched to the string and moved to cock the string;

a lower barrel having side rails for receiving a crossbow bolt and having a channel for retaining the moveable cocking sled, the lower barrel having a muzzle end and a butt end, the muzzle end of the lower barrel coupled to the riser, the arrow release coupled to and held stationary by the lower barrel near the butt end of the lower barrel, the cocking sled latching to the string and moving along the rails of the lower barrel to couple to the arrow release to cock the string, and the cocked string being behind the front side of a shooter's face when aiming and shooting;

a shoulder rest coupled to the butt end of the lower barrel;

a hand grip coupled to the lower barrel, the hand grip including a trigger coupled to the arrow release; and a cover coupled to the lower barrel near the butt end thereof and adapted to rotate toward the lower barrel to cover the string near a shooter's face after the string is cocked.

8. The moveable cocking sled and a stationary arrow release of a crossbow according to claim 7, wherein moveable cocking sled further includes a left pulley and a right pulley that each rotate on respective axles, wherein the string may be cocked by a cocking rope that engages the left pulley and the right pulley.

9. The crossbow according to claim 7, wherein the lower barrel has two sides, wherein the cover has a hinge coupled to one of the two sides of the lower barrel, and wherein the cover rotating on the hinge toward the one of the two sides of the lower barrel to cover the string when the string is cocked.

10. The crossbow according to claim 7, wherein the lower barrel has two sides, wherein the cover has a hinge coupled to one of the two sides of the lower barrel, and wherein the cover rotating on the hinge toward the one of the two sides of the lower barrel to cover the string when the string is cocked; and wherein the crossbow further includes a second cover having a hinge coupled to the other one of the two sides of the lower barrel, and the second cover rotating on its hinge toward the other one of the two sides of the lower barrel to cover the string when the string is cocked.

11. The crossbow according to claim 7, wherein the respective outside perimeters of the first cam and the second cam being disposed within two inches of the lower barrel when the string is cocked.

12. A crossbow, comprising:

a first limb and a second limb, the first limb and the second limb each having a first end and a second end;

a riser coupled to the first end of the first limb and the first end of the second limb;

a first cam with an axle coupled to the second end of the first limb, the first cam having an outside perimeter, a second cam with an axle coupled to the second end of the second limb, the second cam having an outside perimeter;

a string extending between the first cam and the second cam;

a movable cocking sled adapted to latch to the string when moved against the string;

an arrow release adapted to couple to and hold the movable cocking sled when the cocking sled is latched to the string and moved to cock the string;

an upper barrel having side rails, the upper barrel having a muzzle end and a butt end, the muzzle end of the upper barrel coupled to the riser;

a lower barrel having side rails opposite the side rails of the upper barrel for receiving a crossbow bolt, the upper barrel and the lower barrel having a channel for retaining the moveable cocking sled, the lower barrel having a muzzle end and a butt end, the muzzle end of the lower barrel coupled to the riser, the arrow release coupled to and held stationary by the lower barrel near the butt end of the lower barrel, the cocking sled latching to the string and moving along the rails of the upper barrel and the lower barrel to couple to the arrow release to cock the string, and the cocked string being behind the front side of a shooter's face when aiming and shooting;

a shoulder rest coupled to the butt end of the lower barrel;

a hand grip coupled to the lower barrel, the hand grip including a trigger coupled to the arrow release; and a cover coupled to the lower barrel near the butt end thereof and adapted to rotate toward the lower barrel to cover the string near a shooter's face after the string is cocked.

13. The moveable cocking sled and a stationary arrow release of a crossbow according to claim 12, wherein moveable cocking sled further includes a left pulley and a right pulley that each rotate on respective axles, wherein the string may be cocked by a cocking rope that engages the left pulley and the right pulley.

14. The crossbow according to claim 12, wherein the lower barrel has two sides, wherein the cover has a hinge coupled to one of the two sides of the lower barrel, and wherein the cover rotating on the hinge toward the one of the two sides of the lower barrel to cover the string when the string is cocked.

15. The crossbow according to claim 12, wherein the lower barrel has two sides, wherein the cover has a hinge coupled to one of the two sides of the lower barrel, and wherein the cover rotating on the hinge toward the one of the two sides of the lower barrel to cover the string when the string is cocked; and wherein the crossbow further includes a second cover having a hinge coupled to the other one of the two sides of the lower barrel, and the second cover rotating on its hinge toward the other one of the two sides of the lower barrel to cover the string when the string is cocked.

16. The crossbow according to claim 12, wherein the upper barrel and the lower barrel each have two sides, wherein the upper barrel and the lower barrel being spaced apart to provide a slot through which the string passes, wherein the cover rotates toward one side of the two sides of the lower barrel to cover the string when the string is cocked.

17. The crossbow according to claim 12, wherein the upper barrel and the lower barrel each have two sides, wherein the upper barrel and the lower barrel being spaced apart to provide a slot through which the string passes, wherein the cover rotates toward one side of the two sides of the lower barrel to cover the string when the string is cocked, and wherein the crossbow further includes another cover that rotates toward the other side of the two sides of the lower barrel to cover the string when the string is cocked.

18. The crossbow according to claim 12, wherein the respective outside perimeters of the first cam and the second cam being disposed within two inches of the lower barrel when the string is cocked.

* * * * *